US005133547A

United States Patent [19]

Pardi

[11] Patent Number: 5,133,547

[45] Date of Patent: Jul. 28, 1992

[54] SELF-ADJUSTING BASKETBALL GOAL

[75] Inventor: Edward Pardi, Madison, Conn.

[73] Assignee: Jayfro Corporation, Waterford, Conn.

[21] Appl. No.: 643,763

[22] Filed: Jan. 22, 1991

[51] Int. Cl.[5] ..... A63B 63/08

[52] U.S. Cl. ..... 273/1.5 R; 248/284

[58] Field of Search ..... 273/1.5 R, 1.5 A; 248/281.1, 284; 254/10 R, 10 A, 10 B, 10 C

[56] References Cited

U.S. PATENT DOCUMENTS

| | | | |
|---|---|---|---|
| 2,313,188 | 3/1943 | Woodburn | 273/1.5 R |
| 2,986,395 | 5/1961 | Sheftel | 273/1.5 R |
| 3,032,304 | 5/1962 | Machlan | 248/284 |
| 3,329,427 | 7/1967 | Bearson | 273/1.5 R |
| 3,586,632 | 6/1971 | Bearson | 273/1.5 R |
| 3,765,676 | 10/1973 | Bearson et al. | 248/281.1 X |
| 4,330,101 | 5/1982 | Andersen | 273/1.5 R |
| 4,395,040 | 7/1983 | White | 273/1.5 R |
| 4,465,277 | 8/1984 | Dittrich | 273/1.5 R X |
| 4,591,122 | 5/1986 | Kreuzer | 248/281.1 |
| 4,643,342 | 2/1987 | Cramblett | 273/1.5 R |
| 4,738,448 | 1/1988 | Liester | 273/1.5 R |
| 4,781,375 | 11/1988 | Nye | 273/1.5 R |
| 4,798,381 | 1/1989 | Dadbeh | 273/1.5 R |
| 4,801,142 | 1/1989 | Friesen | 273/1.5 R |
| 4,805,904 | 2/1989 | Nye | 273/1.5 R |
| 4,881,734 | 11/1989 | Nye | 273/1.5 R |
| 4,951,944 | 8/1990 | Morgan | 273/1.5 R |

FOREIGN PATENT DOCUMENTS

| | | | |
|---|---|---|---|
| 286216 | 2/1965 | Netherlands | 273/1.5 R |
| 908055 | 10/1962 | United Kingdom | 273/1.5 R |

*Primary Examiner*—Paul E. Shapiro

*Attorney, Agent, or Firm*—Kane, Dalsimer, Sullivan, Kurucz, Levy, Eisele and Richard

[57] ABSTRACT

A basketball goal includes an upright member and a backboard assembly and connecting members for mounting the backboard assembly to the upright member. A pivoting member is used to pivot the backboard assembly to raise or lower the rim. Locking members are also provided to secure the backboard into position after pivoting.

11 Claims, 2 Drawing Sheets

SELF-ADJUSTING BASKETBALL GOAL

BACKGROUND OF THE INVENTION

A. Field of Invention

This invention pertains to a goal useful in playing basketball, and more particularly to a goal having an adjustable height.

B. Description of the Prior Art

Because the game of basketball is very popular, many families, as well as various institutions or organizations catering to the needs of families, install basketball goals on their property. In regulation basketball the height of the basketball must be exactly 10 feet. However, for many children and even adults, this height is not convenient. Therefore, it has been recognized in the art that it would be advantageous to provide a basketball goal having a rim or backboard with an adjustable height. One such goal structure disclosed in U.S. Pat. No. 4,465,277 consists of a vertical member supporting a cantilevered boom with a backboard at one end. However, this structure is large, complicated and too expensive for the home market.

Another goal structure shown in U.S. Pat. No. 4,881,734 consists of a parallelogram disposed on the top of an upright and supporting a backboard and a rim. However, this structure has a number of disadvantages. It relies on a complicated latching mechanism which allows the rim to be set only at certain pre-selected heights. Moreover, the mechanism wears out due to friction and has to be serviced frequently, or even replaced. Due to its complexity, the latch cannot be replaced in the field and must be returned to a shop. In addition, a special tool must be used to engage and disengage the latch for height adjustment.

OBJECTIVES AND SUMMARY OF THE INVENTION

In view of the above-mentioned disadvantages of the prior art, it is an objective of the present invention to provide a basketball goal having a backboard with a height which is easily adjustable.

A further objective is to provide a goal having components which do not need replacement whereby the goal is maintenance free.

Yet another objective is to provide a goal which is relatively simple and inexpensive to manufacture.

Other objectives and advantages of the invention shall become apparent from the following description. Briefly, an adjustable goal constructed in accordance with this invention includes an upright member with an upper end, backboard means, including a backboard and a rim, and upper and lower members arranged to form, with said upright member and said backboard means, a pivotable parallelogram. The goal also includes pivoting means disposed between one of said upper and lower members and said upright member for pivoting said parallelogram thereby raising or lowering the backboard means. The goal further includes locking means for locking said backboard into position so that it remains stable during play.

DETAILED DESCRIPTION OF THE INVENTION

Figure 1:
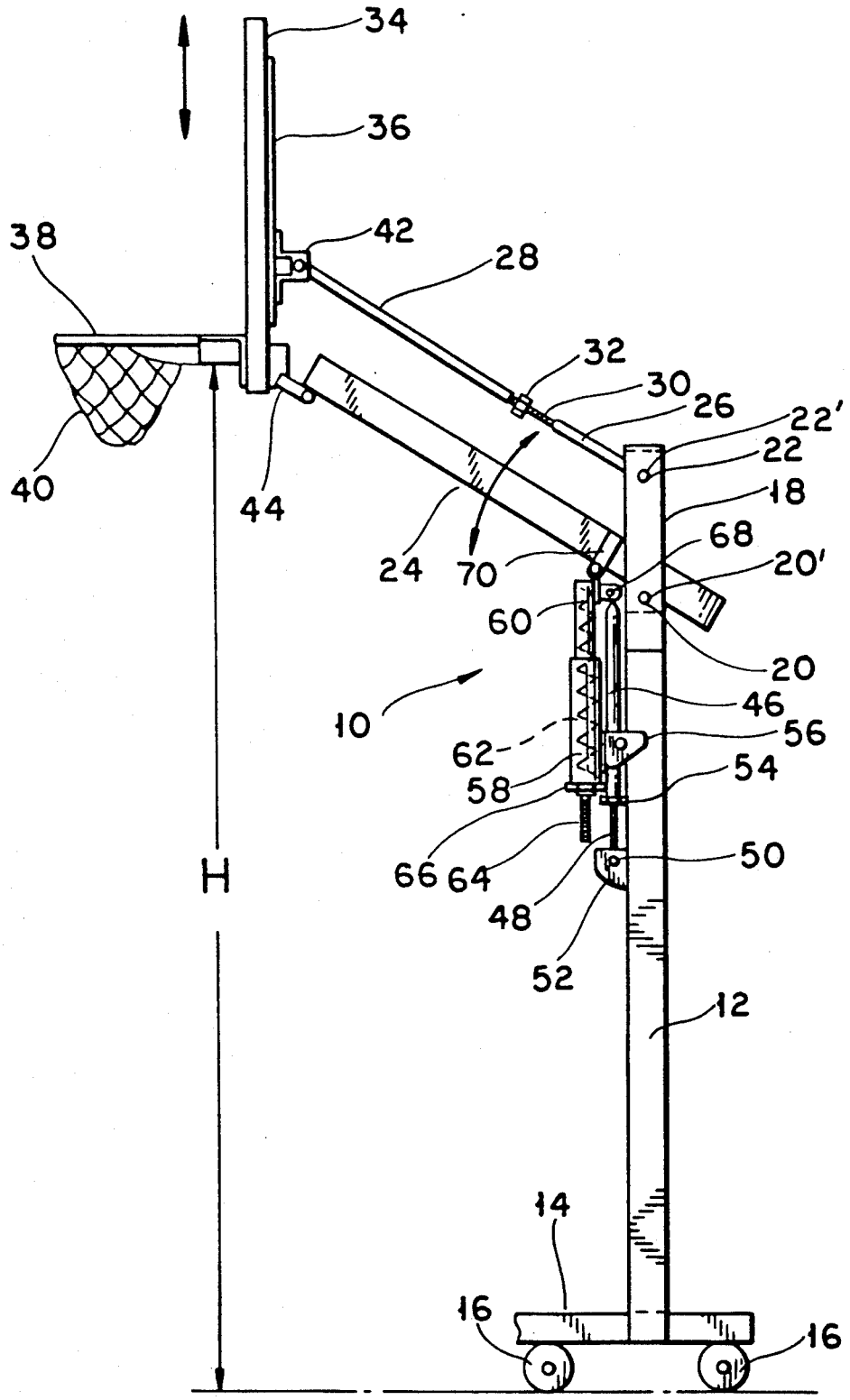
FIG. 1 shows a side elevational view of a basketball goal constructed in accordance with this invention.
Figure 2:
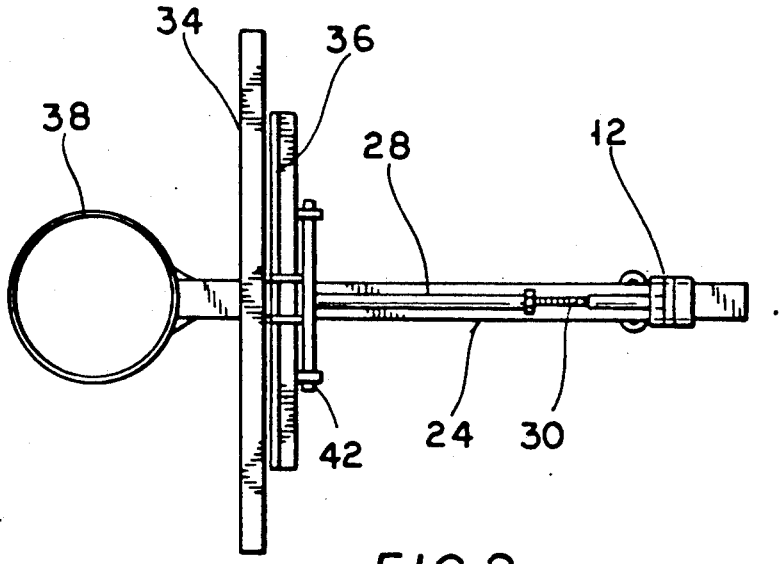
FIG. 2 shows a top view of the goal of FIG. 1.

Referring now to the Figures, a basketball goal 10 constructed in accordance with this invention includes an upright member 12. This member may have either a square or a round 10 cross section. The lower end of member 12 may be anchored into the ground, or may be mounted securely on a platform 14. Platform 14 has wheels 16 which permit the platform to be moved at will. Of course, during play the platform is firmly anchored by locking wheels 16, or by other similar means.

At the top, upright member 12 is formed with a vertical elongated slot 18 communicating with the side walls of the member 12 by pin holes 20, 22. Pin hole 20 holds a pin 20' for rotatably mounting an outrigger 24 as shown. Outrigger 24 may have a square or round cross section. Similarly pin hole 22 is used to hold another pin 22' for rotatably mounting a sleeve 26. This sleeve 26 is coupled to a second sleeve 28 by a threaded rod 30. Mounted on rod 30 there is a lock nut 32.

Goal 10 also includes a backboard assembly consisting of a backboard 34, a frame 36 disposed behind, and secured to the backboard, and a rim 38. A conventional net 40 hangs down from rim 38. Secured to frame 36 there is a bracket 42 in pivotal engagement with the distal end of sleeve 28. Below bracket 42 there is an adapter 44 for pivotally coupling the distal end of outrigger 24 to frame 36. The threaded bar 30 may be turned to adjust the distance between the two sleeves 26, 38 such that a parallelogram is defined by the sleeves, outrigger 24, the top portion of upright member 12, and frame 36. The position of the rod is secured by tightening lock nut 32 against sleeve 28. By pivoting the sides of this parallelogram, the height H of rim 38 may be adjusted by pivoting the parallelogram around pins 20' and 22'. Importantly, during this process the backboard 34 is maintained parallel to member 18 and therefore remains vertical.

Goal 10 also includes a vertical sleeve 46 slidably engaged by a threaded rod 48. A lower end of rod 48 is engaged by a pin 50 pivoting in a bracket 52. A lock nut 54 is mounted on rod 48. Bracket 52 is secured to upright member 12. Another bracket 56 also secured to upright 12 is used to hold a cylinder assembly including a cylinder 58. The top of the cylinder 58 is open to receive and engage telescopically a second cylinder 60. These two cylinders 58, 60 cooperate to form a spring chamber for a coil spring 62 to keep the two cylinders 58, 60 separated. A threaded rod 64 is secured to upper cylinder 60, and is disposed concentrically within the two cylinders. The rod, furthermore, protrudes through the bottom of cylinder 58. Lock nut 66 is mounted on rod 64 below cylinder 58 as shown.

Cylinder 60 is pivotally secured at the top to the top of sleeve 46 by a pin 68. A bracket 70 is mounted on outrigger 24 and is pivotally secured to the top of cylinder 60.

Figure 3:
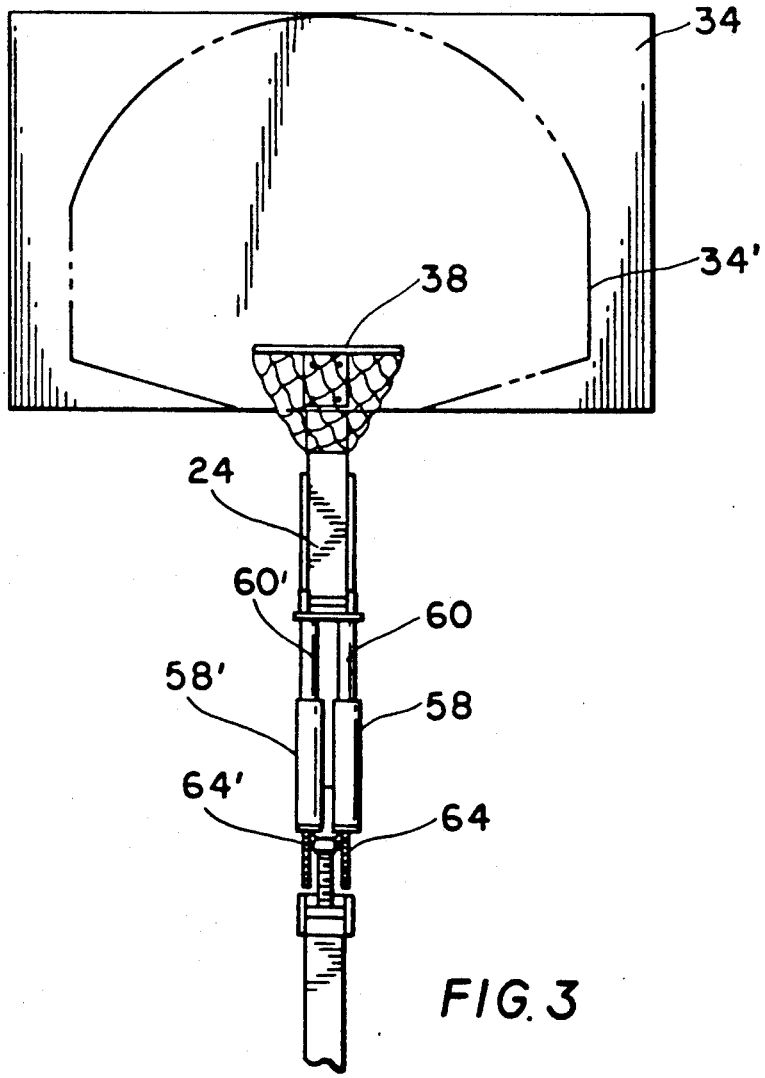
FIG. 3 shows a partial front view thereof.

The goal 10 may be provided with a single cylinder assembly, or with two assemblies disposed in parallel as shown in FIG. 3, each having a lower cylinder 58, 58', an upper cylinder 60, 60', a threaded rod 64, 64' and so on. Moreover, as shown in FIG. 3, backboard 34 may be either rectangular, or may have the shape indicated in dashed line as at 34'.

The goal described above may be adjusted as follows. Normally the backboard assembly is locked into position by lock nuts 54 and 66. Lock nut 54 stops cylinder 60, and therefore the backboard assembly from moving downward. Lock nut 66 stops cylinder 60 from moving upward. This feature of the invention insures that the backboard remains stable even under extreme conditions, for example when a person performs a dunk shot. In order to move the backboard assembly up, lock nut 60 is turned clockwise (assuming that rod 64 is threaded in the normal direction). This action allows the threaded rod 64, and cylinder 60 to move upward. The upward movement of cylinder 60 forces the parallelogram to pivot clockwise (as viewed in FIG. 1) thereby raising the backboard assembly. The movement of the cylinder 60 upward also forces sleeve 46 to move upward, away from lock nut 54. When the desired position of the backboard assembly is reached, lock nut 54 is turned counter-clock wise to move up until it re-engages sleeve 46. Thus, the backboard is once again locked into its position.

To lower the backboard assembly, the sequence is reversed. The lock nut 54 is turned clockwise to move it downward along threaded rod 48. This allows the sleeve 46 to move downward pulling cylinder 60 with it, and forcing the parallelogram to pivot counter-clockwise. This pivoting action lowers the backboard assembly.

One skilled in the art will appreciate that the position of the backboard and rim is continuously adjustable to any desired height.

Preferably the spring 62 is selected so that its coupling moment exceeds the coupling moment of the weight of the backboard assembly, the sleeves 26, 46 and outrigger 24. Under these conditions, the backboard will move upward unassisted, however, an extra force must be applied to it by hand or other means to make it move downward.

Obviously numerous modifications may be made to this invention without departing from its scope as defined in the appended claims.

I claim:

1. An adjustable basketball goal comprising: an upright member having an upper end; backboard means;

an upper and a lower member pivotably secured between said upright member and said backboard means for mounting said backboard means;

said upper and lower member, said backboard means and said end cooperating to form a pivotable parallelogram;

pivoting means disposed between one of said upper and lower members and said upright member for pivoting said parallelogram to change the height of said backboard means, said pivoting means including a pair of telescoping cylinders, with one cylinder being attached to the upright member and the other cylinder being attached to said one of said upper and lower members; and locking means for locking said backboard means into a selected position.

2. The basketball goal of claim 1 further comprising spring means disposed between said cylinders for applying a biasing force therebetween.

3. An adjustable basketball goal comprising:

an upright member having an upper end;

backboard means including a backboard and a rim secured to said backboard;

an upper and a lower member pivotable secured between said upright member and said backboard means for mounting said backboard means;

said upper and lower member, said backboard means and said end cooperating to form a pivotable parallelogram;

pivoting means disposed between one of said upper and lower members and said upright member for pivoting said parallelogram to change the height of said backboard means, said pivoting means including first pivoting rod means for selectively rotating said parallelogram in a first direction, and second pivoting rod means for rotating said parallelogram in the opposite direction; and locking means for locking said backboard means into a selected position.

4. The basketball goal of claim 3 wherein said pivoting means includes a first cylinder secured to said upright member and a second cylinder secured to said parallelogram.

5. The basketball goal of claim 4 wherein first pivoting rod means includes a sleeve secured at one end to said second cylinder and a rod engaging said sleeve and secured to said upright.

6. The basketball goal of claim 5 wherein said second pivoting rod means includes a second rod extending between said first and second cylinders.

7. An adjustable goal comprising:

an upright having an upper end;

a backboard assembly including a frame, a backboard mounted on said frame, and a rim secured to said backboard;

an upper member extending between and pivotally secured to said frame and said upper end;

a lower member extending between and pivotally secured to said frame and said upper end, said lower member, said upper member, said frame and said upper end cooperating to form a pivotable parallelogram;

cylinder means disposed between one of said upper and lower members for selective pivoting said parallelogram; and locking means for locking said cylinder means to prevent said parallelogram from pivoting.

8. The adjustable goal of claim 7 wherein said locking means includes upper locking means for preventing pivoting upward, and lower locking means for preventing pivoting downward.

9. The adjustable goal of claim 7 wherein said locking means is secured to said lower member.

10. The adjustable goal of claim 9 further comprising platform means for holding said goal.

11. The adjustable goal of claim 10 further comprising wheel means attached to said platform for moving said goal along a surface.

* * * * *

UNITED STATES PATENT AND TRADEMARK OFFICE

CERTIFICATE OF CORRECTION

PATENT NO. : 5,133,547
DATED : July 28, 1992
INVENTOR(S) : Edward Pardi

It is certified that error appears in the above-identified patent and that said Letters Patent is hereby corrected as shown below:

Column 4,
Line 45, delete "for selective pivoting" and insert -- and said upright for selective pivoting of --

Signed and Sealed this

Nineteenth Day of August, 2003

JAMES E. ROGAN
*Director of the United States Patent and Trademark Office*